United States Patent [19]

Dabholkar et al.

[11] Patent Number: 4,742,515

[45] Date of Patent: May 3, 1988

[54] DATA ACQUISTION AND CONTROL SYSTEM

[75] Inventors: Harsha M. Dabholkar, Northbrook; Gideon Shavit, Highland Park, both of Ill.

[73] Assignee: Honeywell Inc., Minneapolis, Minn.

[21] Appl. No.: 748,074

[22] Filed: Jun. 24, 1985

[51] Int. Cl.[4] ..... H08J 3/04

[52] U.S. Cl. ..... 370/112; 340/347 M

[58] Field of Search ..... 370/112, 58, 113, 114; 307/243; 328/104; 340/347 M

[56] References Cited

U.S. PATENT DOCUMENTS

| | | | |
|---|---|---|---|
| 4,361,839 | 11/1982 | Betterini | 370/112 |
| 4,473,901 | 9/1984 | Jensen | 370/114 |
| 4,498,166 | 2/1985 | Esposito | 370/112 |

*Primary Examiner*—Douglas W. Olms
*Assistant Examiner*—Frank M. Scutch, III
*Attorney, Agent, or Firm*—Donald J. Lenkszus

[57] ABSTRACT

A data acquisition system has a plurality of input/output lines any of which may be used to receive either analog or digital signals. Furthermore, some of the input/output lines may be used to provide a voltage output and some of the input/output lines may be used to provide a current output.

13 Claims, 2 Drawing Sheets

DATA ACQUISTION AND CONTROL SYSTEM

The present application relates to data acquisition systems, and more specifically to data acquisition systems capable of handling both analog and digital data.

BACKGROUND OF THE INVENTION

In the past data acquisition systems have typically had a fixed number of input lines for receiving signals and a fixed number of output lines for providing either electrical current or voltage to sensors or other apparatus from which data is to be acquired. Furthermore, in typical prior art systems a signal input line must be designated to receive either a digital signal or an analog signal when the data acquisition system is constructed.

In modular systems a data acquisition system may be desired to be connected to different types of sensors on different occasions. Some of these sensors will require a voltage reference while others will require a current reference. Also, some of these sensors will provide a digital output while others will provide an analog output. A data acquisition system which could provide varying combinations of electrical current and voltages to the sensors to be monitored and receive varying combinations of digital and analog signals would be desirable.

SUMMARY OF THE INVENTION

The present invention provides a data acquisition system having a plurality of input lines which may be used to receive either analog or digital signals. Some of these lines may selectively be used to provide an electrical current as an output rather than to receive input signals. Furthermore, some of the lines may be selectively used to provide a voltage output rather than receive an input.

DETAILED DESCRIPTION OF THE PREFERRED EMBODIMENT

Figure 1:
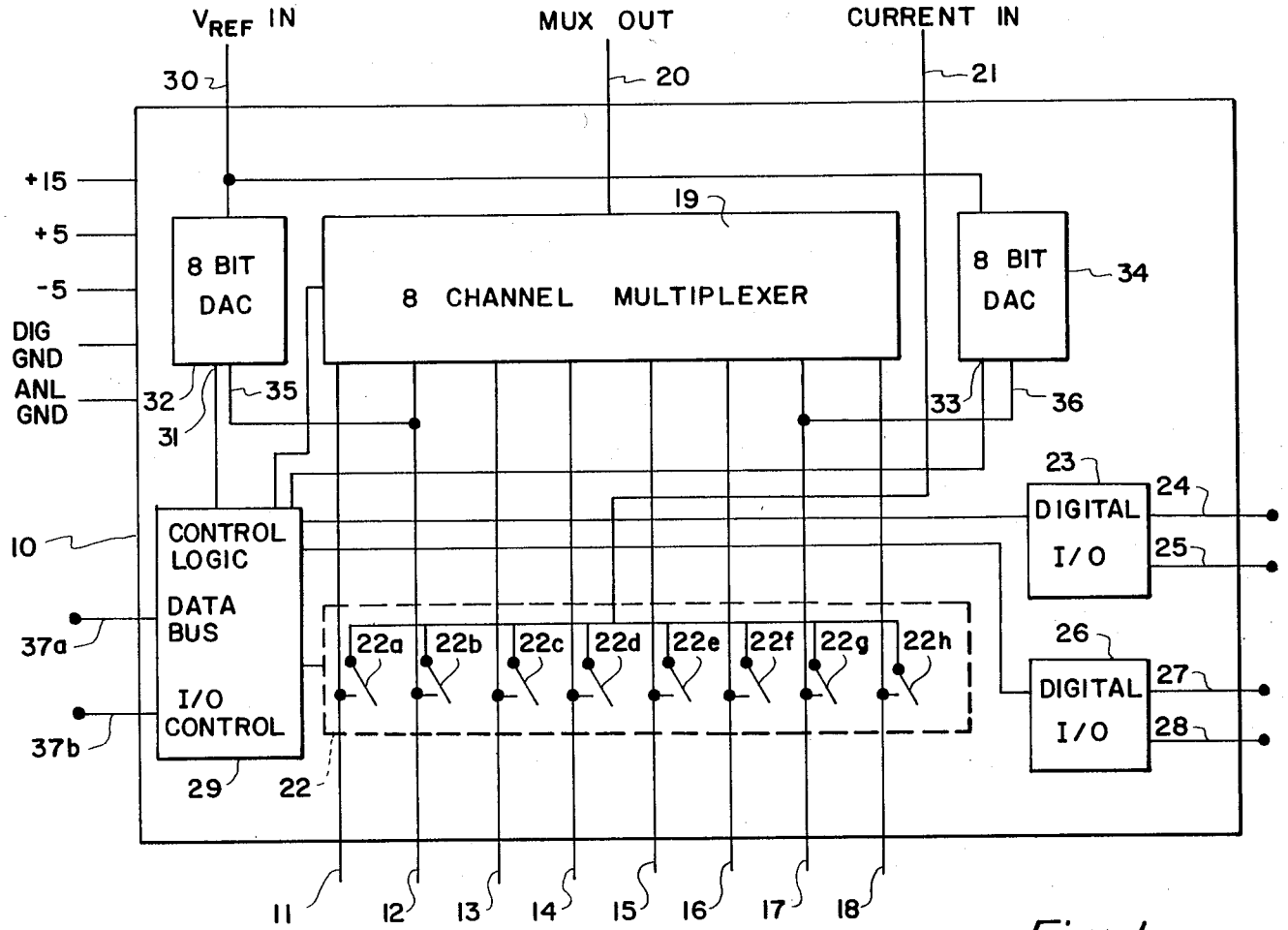
FIG. 1 is a block diagram of the sensor actuator interface of the invention.

FIG. 1 shows the portion of the invention known as the sensor actuator interface (SAI). The SAI, designated generally as 10, includes 8 input/output lines, 11, 12, 13, 14, 15, 16, 17, and 18. Although 8 input/output lines are shown any number could be used within the scope of the invention. Each of input/output lines 11 through 18 is electrically connected to multiplexer 19. Multiplexer 19 provides an output representative of the multiplexed signals received on input/output lines 11 through 18 which are used to receive signals at multiplexer output line 20.

Input/output lines 11 through 18 may also be used as current outputs rather than signal inputs. In order to do so, an electrical current is supplied to current input 21. Current input 21 is electrically connected to switches 22*a* through 22*h* of switch set 22. Input/output lines 11 through 18 may then be used as electrical current outputs by closing switches 22*a* through 22*h*, respectively. The invention is not limited to a system having 8 terminals which may be used as current outputs. Any number of input/output lines 11 through 18 could be provided with such switches to allow them to be used as electrical current outputs. Furthermore, more than one current input could be supplied so that different ones of input/output lines 11 through 18 could be connected to different electrical current sources.

FIG. 1 also includes control logic 29. Control logic 29 communicates with external circuitry via data bus 37*a* and input/output control bus 37*b*. Control logic 29 provides signals to switch set 22 to control whether each of switches 22*a* through 22*h* will be open or closed.

Control logic 29 is electrically connected to input region 31 of digital to analog converter 32 and input region 33 of digital to analog converter 34. Digital to analog converter 32 has an output region 35 which is electrically connected to SAI input/output line 12. Digital to analog converter 34 has an output region 36 which is electrically connected to SAI input/output line 17. In order to use input/output line 12 as a voltage source rather than an input region, a digital signal is transmitted to digital input bus 37*a* by external circuitry. This digital signal is transmitted to digital to analog converter 32 by control logic 29 where it is stored. Digital to analog converter 32 provides an output voltage the value of which is determined by the value of that digital signal. Digital to analog converter 32 will continue to produce the same voltage until a different digital signal is transmitted to it. Likewise, input/output line 17 may be used as a voltage source by storing a digital signal in digital to analog converter 34. As described with regard to the electrical current sources, the number of terminals which may be used as voltage sources is not limited to the number shown in FIG. 1. More or less could be provided.

Additionally shown in FIG. 1 are digital input/output mean 23 and 26 having input buses 24 and 27 and output buses 25 and 28, respectively. Control logic 29 transmits digital signals to digital input/output means 23 and 27 which subsequently transmit such information to external circuitry via output buses 25 and 28, respectively. Similarly, digital input/output means 23 and 27 receive digital input signals on digital inputs buses 24 and 27, respectively, and transmits such information to control logic 28, which retransmits such information, bypassing multiplexer 19.

Figure 2:
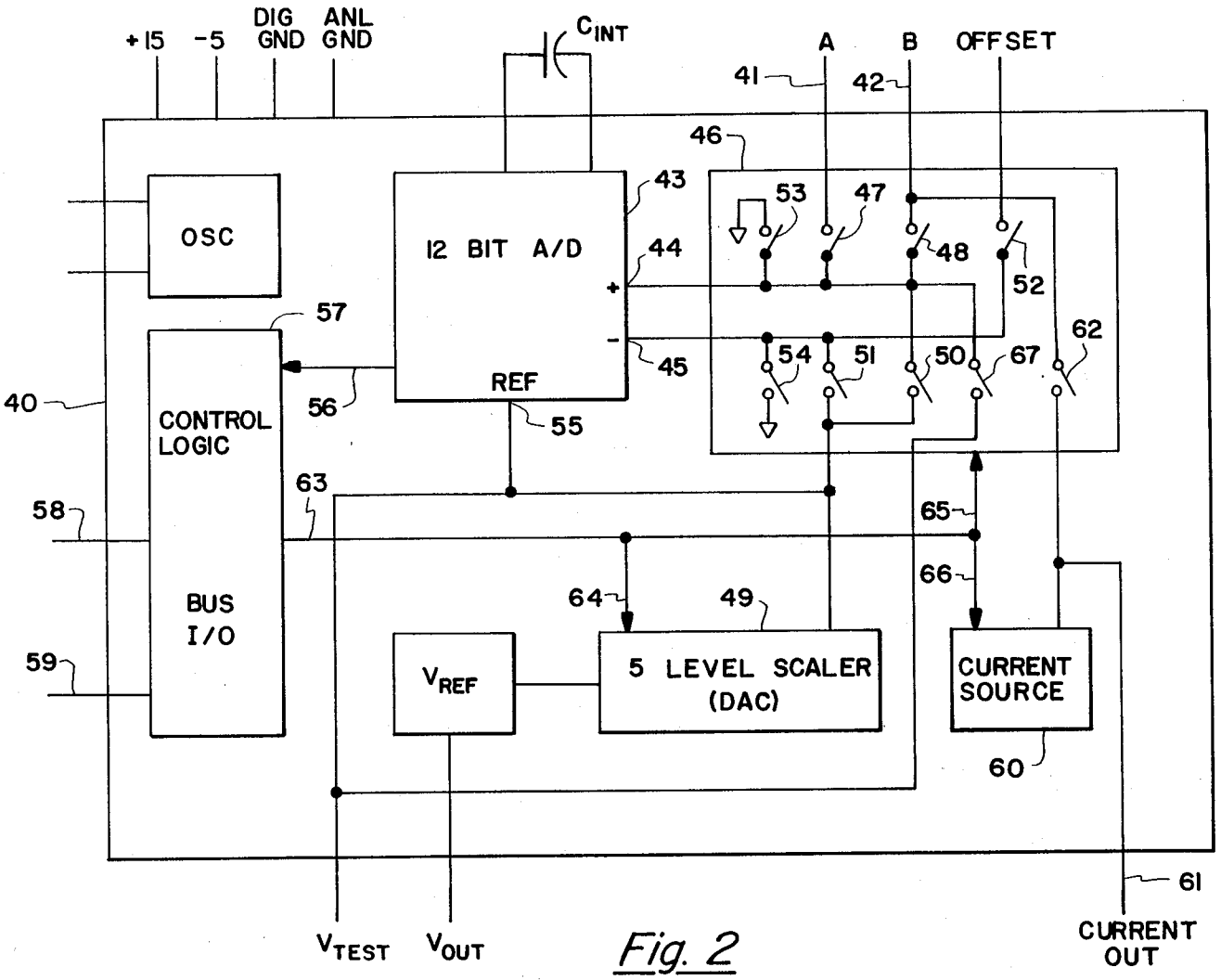
FIG. 2 is a block diagram of the analog conversion module of the interface.

FIG. 2 illustrates the analog conversion module (ACM) 40 which would be used in conjunction with the SAI of FIG. 1. ACM 40 has terminals 41 and 42. Terminal 41 is a data input terminal which normally would be electrically connected to output terminal 20 of the SAI of FIG. 1. Terminal 42 may be used as a second data input terminal and connected to an output terminal of a second SAI or some other data source, or terminal 42 may be used as a current output terminal. ACM 40 also includes an analog to digital converter 43 having input regions 44 and 45. In a preferred embodiment, analog to digital converter 43 produces a 12 bit output although this may be changed to fit a particular application. The input signals received at inputs 44 and 45 of analog to digital converter 43 are controlled by switch set 46. By closing switch 47 the input signal received at terminal 41 may be directed to input 44 of analog to digital converter 43. Similarly, by closing switch 48 input signals received at terminal 42 may be directed to input 44 of analog to digital converter 43. Five level scalar 49 acts as a programmable voltage source, producing an internally generated voltage which may be directed to input 44 or input 45 of analog to digital converter 43 by closing switch 50 or 51 respectively. Alternatively, an externally generated offset voltage may be directed to input 45 of analog to digital converter 43 by closing switch 52. Furthermore, either input 44 or input 45 of analog to digital converter 43 may be connected to an electrical ground potential by closing switch 53 or 54 respectively. These options provide a variety of offset voltages for use in converting the analog to digital conversion process. On other option is provided by switch 67 which, when closed, directs a test voltage to input 44 of analog to digital converter 43 for testing to insure that analog to digital converter 43 is operating properly.

Five level scalar 49 also supplies a reference voltage to reference voltage input 55 of analog to digital converter 43. This reference voltage is used by analog to digital converter 43 in the analog to digital conversion process.

Analog to digital converter 43 provides a digital value representative of the input signals received at analog to digital converter 43 input terminals 44 and 45 and provides that representation at analog to digital converter output terminal 56. This digital signal is provided to control logic 57 which in turn communicates with external circuitry through ACM terminals 58 and 59. The external circuitry would typically be a microprocessor although other external circuitry could also be used.

Those skilled in the art will note that all signals received on input/output lines 11 through 18 are processed by analog to digital converter 43 including those which are digital signals originally. Analog to digital converter 43 provides a digital signal, the numerical value of which is representative of the voltage level of the input signal. Digital electronic systems typically choose a particular voltage level and define bits exhibiting a voltage greater than that level to represent a first value, typically one, and those exhibiting voltage lower than the predefined level to represent a second value, typically zero. Any input received on signal lines 11 through 18 of FIG. 1 which is intended to represent a bit of a digital signal and which has its voltage digitized to a value which is greater than the value which represents the preselected voltage level is interpreted as a one and any such input signal which has its voltage digitized to a value which is less than the value representing the preselected value is interpreted as a zero.

Current source 60 provides an electrical current at electrical current output 61. Typically electrical current output 61 would be electrically connected to electrical current input terminal 21 of SAI 10 of FIG. 1. Additionally, by closing switch 62 of switch set 46, terminal 42 of ACM 40 may used as a second electrical current output rather than as a signal input.

Control logic 57, besides providing communication with external circuitry, provides control signals on control bus 63. A set of the control signals provided on control bus 63 is provided to five level scalar 49 at five level scalar 49 control input 64. These signals control what voltages are to be transmitted to switches 50 and 51 of switch set 46 and to reference voltage input 55 of analog to digital converter 43. A second set of control signals is transmitted to switch set 46 control input 65 in order to control which switches of switch set 46 will be closed. A third set of control signals is provided at current source control input 66 in order to control the magnitude of the current produced by current source 60.

ACM 40 further includes oscillator 67. Oscillator 67 produces timing signals for use by analog to digital converter 43 and other circuitry of ACM 40 as well as a clock output signal for external circuits.

In operation and by way of example input/output lines 11 and 13 of FIG. 1 might be connected to the outputs of sensors which produce digital output signals. Input/output line 12 might be connected to the input line of a sensor which requires a voltage reference or bias, such as a capacitive sensor Input/output lines 14 and 15 might be connected to the input lines of sensors requiring an electrical current input, such as variable resistors. Input/output line 16 might be connected to a actuator which requires an electrical current to be activated while input/output line 17 might be connected to an actuator which requires an electrical voltage to be activated. Finally, input/output line 18 might be connected to the output of a sensor which provides an analog output signal.

Under the conditions described above, digital to analog converter 28 would typically be programmed to provide the voltage required by the sensor connected to input/output line 12. Switchs *22a, 22b, 22c, 22g,* and *22h* would be left open at all times while switches *22d* and *22e* would be left closed at all times, assuming, of course, that the sensors connected to lines 14 and 15 are to be active at all times. Switch *22f* would typically be open until such time as the actuator connected to input/output line 16 is to be activated. That time might be determined by a timer or by the information received from a sensor connected to SAI 10 and other similar SAI's or by a combination of these. When the actuator attached to input/output line 16 is to be activated switch *22f* is closed. Similarly, digital to analog converter 34 would typically be programmed to provide a high impedence signal until the actuator connected to input/output line 17 is to be activated. At that time digital to analog converter 33 would be reprogrammed to produce the required voltage.

Signals arriving on input/output lines 11, 12 and 18 would be multiplexed by multiplexer 19 and sent to ACM 40 of FIG. 2. There those signals are digitized by analog to digital converter 43. The signals are then sent to control logic 57. Either control logic 57 or the external circuitry to which it is connected should be programmed to correctly interpret data from input/output lines 11 and 12 as coming from a digital signal source and that from input/output line 18 as coming from an analog signal source.

Those skilled in the art will perceive that the system of the present invention is designed to be as versatile as possible. The discussion of the operation of the system is, therefore, given by way of example only. Many other connection schemes may be used within the context of the invention.

The embodiments of the invention in which an exclusive property or right is claimed are defined as follows:

1. A data acquisition system comprising:

a plurality of input/output lines, each of said input/output lines being capable of receiving either digital or analog signals as input, at least one of said input/output lines being capable of providing an electrical current as an output, and at least one of said input/output lines being capable of providing an electrical voltage as an output;

a multiplexer electrically connected to said input/output lines, for multiplexing signals received on those of said input/output lines receiving signals;

an analog to digital converter for receiving said multiplexed signals and providing a digital representation thereof;

an electrical current source adapted to be electrically connected to at least one of said input/output lines which is capable of providing an electrical current as an output; and a first electrical voltage source adapted to be electrically connected to at least one of said input/output lines.

2. The data acquisition system of claim 1 wherein said first electrical voltage source comprises a digital to analog converter.

3. The data acquisition system of claim 1 further comprising a second electrical voltage source adapted to be connected to one of said input/output lines.

4. The data acquisition system of claim 3 wherein each of said first and second electrical voltage sources comprise a digital to analog converter.

5. The data acquisition system of claim 1 further comprising a programable electrical voltage source for providing an offset signal to said analog to digital converter.

6. The data acquisition system of claim 1 further comprising control logic means for receiving said digital representation of said multiplexed signals and for providing system control signals to other portions of said system.

7. The data acquisition system of claim 6 wherein said control logic means is adapted to provide said digital representation of said multiplexed signals to external circuitry.

8. The data acquisition system of claim 6 wherein said first electrical voltage source comprises a digital to analog converter.

9. The data acquisition system of claim 6 further comprising a second electrical voltage source adapted to be connected to one of said input/output lines.

10. The data acquisition system of claim 9 wherein each of said first and second electrical voltage sources comprise a digital to analog converter.

11. The data acquisition system of claim 10 wherein said control logic means is adapted to provide said digital representation of said multiplexed signals to external circuitry.

12. The data acquisition system of claim 6 further comprising a programable electrical voltage source for providing an offset signal to said analog to digital converter.

13. The data acquisition system of claim 12 wherein said control logic means is adapted to provide said digital representation of said multiplexed signals to external circuitry.

* * * * *